US005255339A

United States Patent [19]

Fette et al.

[11] Patent Number: 5,255,339

[45] Date of Patent: Oct. 19, 1993

[54] LOW BIT RATE VOCODER MEANS AND METHOD

[75] Inventors: Bruce A. Fette, Mesa; Cynthia A. Jaskie, Scottsdale, both of Ariz.

[73] Assignee: Motorola, Inc., Schaumburg, Ill.

[21] Appl. No.: 732,977

[22] Filed: Jul. 19, 1991

[51] Int. Cl.[5] ..... G10L 9/04

[52] U.S. Cl. ..... 395/2

[58] Field of Search ..... 381/29–41; 395/2; 370/110.1

[56] References Cited

U.S. PATENT DOCUMENTS

| | | | |
|---|---|---|---|
| 3,873,776 | 3/1975 | Smith et al. | 370/110.1 |
| 4,220,819 | 9/1980 | Atal | 179/1 |
| 4,330,689 | 5/1982 | Kang et al. | 179/15.55 R |
| 4,516,241 | 5/1985 | Farah et al. | 370/110.1 |
| 4,536,886 | 8/1985 | Papamichalis et al. | 381/41 |
| 4,625,286 | 11/1986 | Papmichallis et al. | 364/513.5 |
| 4,630,300 | 12/1986 | Kang et al. | 381/31 |
| 4,677,671 | 6/1987 | Galand | 381/31 |
| 4,791,670 | 12/1988 | Venaria et al. | 381/41 |
| 4,797,925 | 1/1989 | Lin | 381/36 |
| 4,815,134 | 3/1989 | Picone et al. | 381/31 |
| 4,817,157 | 3/1989 | Gerson | 381/40 |
| 4,852,179 | 7/1989 | Fette | 381/29 |
| 4,890,327 | 12/1989 | Bertrand | 381/38 |
| 4,896,361 | 1/1990 | Gerson | 381/40 |
| 4,899,385 | 2/1990 | Ketchum et al. | 381/36 |
| 4,910,781 | 3/1990 | Ketchum et al. | 381/36 |
| 4,914,699 | 4/1990 | Dunn et al. | 380/34 |
| 4,922,539 | 5/1990 | Rauasekaran et al. | 381/50 |
| 4,933,957 | 6/1990 | Bottau et al. | 375/27 |
| 4,965,789 | 10/1990 | Bottau et al. | 370/79 |
| 4,975,956 | 12/1990 | Liu et al. | 381/36 |
| 4,980,916 | 12/1990 | Zinser | 381/36 |
| 5,016,278 | 5/1991 | Rochette et al. | 381/36 |
| 5,016,279 | 5/1991 | Kawama et al. | 381/36 |

OTHER PUBLICATIONS

An article entitled "A 450 BPS Vocoder with Natural--Sounding Speech" by Y. M. Cheng et al., INR-S-Telecommunications, *IEEE* 1990, pp. 649–652.

An article entitled "A 500–800 bps Adaptive Vector Quantization Vocoder Using a Perceptually Motivated Distance Measure" by D. B. Paul, M. I. T. Lincoln Laboratory, Lexington, Mass. 02173, *IEEE* 1982, pp. 1079–1082.

An article entitled "A High Quality Speech Coder at 400 BPSS" by Y. J. Liu et al., ITT Defense Communications Division, Nutley, New Jersey, *IEEE* 1989, pp. 204–206.

An article entitled "A High-Quality Speech Coder at 600 BPS" by Y. J. Liu, ITT Defense Communications Divisions, Nutley, New Jersey, *IEEE* 1990, pp. 645–648.

An article entitled "A Multiple Rate Low Rate Voice CODEC" by J. Rothweller et al., ITT Defense Communications Division, Nutley, NJ, *IEEE* 1985, pp. 248–251.

(List continued on next page.)

*Primary Examiner*—Michael R. Fleming
*Assistant Examiner*—Michelle Doerrler
*Attorney, Agent, or Firm*—Robert M. Handy; Frederick M. Fliegel

[57] ABSTRACT

Efficient coding speech information for low rate (e.g., 600 bps) channels using a four frame superframe (SF) includes: (1) coding spectral information using alternative quantizers one of which is chosen for each superframe so that 3 bits/SF identify the optimal quantizer and 28–32 bits/SF contain the quantized spectral information; (2) coding pitch using 5 bits/SF if voiced and if unvoiced assigning the pitch bits to error correction; (3) coding energy using 9–12 bits/SF by a 4d vector quantizer (4dvQ); and (4) coding voicing using 3–4 bits/SF by a 4d VQ, for a total of 54 bits/SF including 1 sync bit and 0–1 error correction bits. When combined with a unique perceptual weighting scheme, output speech quality comparable to that of vocoders operating at almost four times the channel capacity is obtained.

19 Claims, 6 Drawing Sheets

OTHER PUBLICATIONS

An article entitled "A Phonetic Vocoder" by J. Picone et al., *Speech and Image Understanding Laboratory,* Texas Instruments, Inc., Dallas, TX, *IEEE* 1989, pp.580-583.

An article entitled "An 800 BPS Adaptive Vector Quantization Vocoder Using a Perceptual Distance Measure" D. B. Paul, M. I. T., Lincoln Laboratory, Lexington, MA, *IEEE* 1983, pp. 73-76.

An article entitled "Application of Line-Spectrum Pairs to Low-Bit-Rate Speech Encoders" by G. S. Kang et al., Naval Research Laboratory, Washington, D.C., pp. 244-247.

An article entitled "Improving Intelligibility of a 300 B/S Segment Vocoder" by P. Peterson et al., BBN System and Technologies Corp., Cambridge, MA, *IEEE* 1990, pp. 653-656.

An article entitled "Low-Bit-Rate Speech Encoders Based on Line-Spectrum Frequencies (LSFs)" by G. S. Kang et al., NRL (Naval Research Laboratory) Report 8857, Jan. 1985 pp. 1-44.

An article entitled "Vector Quantization in Speech Coding" by J. Makhoul et al., Proceedings of the IEEE, vol. 73, No. 11, Nov. 1985, pp. 1551-1588.

An article entitled "Vector Sum Excited Linear Prediction (VSELP) Speech Coding at 4.8 kbps" by I. A. Gerson et al., International Mobile Satellite Conference, Ottawa, 1990, pp. 678-683.

An article entitled "The Waveform Segment Vocoder: A New Approach for Very-Low-Rate Speech Coding" by S. Roucos et al., Bolt Beranek and Newman Inc., Cambridge, MA, *IEEE* 1985, pp. 236-239.

LOW BIT RATE VOCODER MEANS AND METHOD

FIELD OF THE INVENTION

The present invention concerns an improved means and method for coding of speech, and more particularly, coding of speech at low bit rates.

BACKGROUND OF THE INVENTION

Modern communication systems make extensive use of coding to transmit speech information under circumstances of limited bandwidth. Instead of sending the input speech itself, the speech is analyzed to determine its important parameters (e.g., pitch, spectrum, energy and voicing) and these parameters transmitted. The receiver then uses these parameters to synthesize an intelligible replica of the input speech. With this procedure, intelligible speech can be transmitted even when the intervening channel bandwidth is less than would be required to transmit the speech itself. The word "vocoder" has been coined in the art to describe apparatus which performs such functions.

FIG. 1 illustrates vocoder communication system 10. Input speech 12 is provided to speech analyzer 14 wherein the important speech parameters are extracted and forwarded to coder 16 where they are quantized and combined in a form suitable for transmission to communication channel 18, e.g., a telephone or radio link. Having passed through communication channel 18, the coded speech parameters arrive at decoder 20 where they are separated and passed to speech synthesizer 22 which uses the quantized speech parameters to synthesize a replica 24 of the input speech for delivery to the listener.

Many different types of vocoders have been described in the prior art, as for example in U.S. Pat. Nos. 4,220,819, 4,330,689, 4,536,886, 4,625,286, 4,630,300, 4,677,671, 4,791,670, 4,797,925, 4,815,134, 4,817,157, 4,852,179, 4,890,327, 4,896,361, 4,899,385, 4,910,781, 4,914,699, 4,922,539, 4,933,957, 4,965789, 4,975,956 and 4,980,916 which are incorporated herein by reference.

As used in the art, "pitch" generally refers to the period or frequency of the buzzing of the vocal cords or glottis, "spectrum" generally refers to the frequency dependent properties of the vocal tract, "energy" generally refers to the magnitude or intensity or energy of the speech waveform, "voicing" refers to whether or not the vocal cords are active, and "quantizing" refers to choosing one of a finite number of discrete levels to characterize these ordinarily continuous speech parameters. The number of different quantized levels for a particular speech parameter is set by the number of bits assigned to code that speech parameter. The foregoing terms are well known in the art and commonly used in connection with vocoding.

Vocoders have been built which operate at 200, 400 600, 800, 900, 1200, 2400, 4800, 9600 bits per second and other rates, with varying results depending, among other things, on the bit rate. The narrower the transmission channel bandwidth, the smaller the allowable bit rate. The smaller the allowable bit rate the more difficult it is to find a coding scheme which provides clear, intelligible, synthesized speech. In addition, practical communication systems must take into consideration the complexity of the coding scheme, since unduly complex coding schemes cannot be executed in substantially real time or using computer processors of reasonable size, speed, complexity and cost. Processor power consumption is also an important consideration since vocoders are frequently used in hand-held and portable apparatus.

While prior art vocoders are used extensively, they suffer from a number of limitations well known in the art, especially when low bit rates are desired. Thus, there is a continuing need for improved vocoder methods and apparatus, especially for vocoders capable of providing highly intelligible speech at low or moderate bit rates.

As used herein, the word "coding" is intended to refer collectively to both coding and decoding, i.e., both creation of a set of quantized parameters describing the input speech and subsequent use of this set of quantized parameters to synthesize a replica of the input speech.

As used herein, the words "perceptual" and "perceptually" refer to how speech is perceived, i.e., recognized by a human listener. Thus, "perceptual weighting" and "perceptually weighted" refer, for example, to deliberately modifying the characteristic parameters (e.g., pitch, spectrum, energy, voicing) obtained from analysis of some input speech so as to increase the intelligibility of synthesized speech reconstructed using such (modified) parameters. Development of perceptual weighting schemes that are effective in improving the intelligibility of the synthesized speech is a subject of much long standing work in the art.

SUMMARY OF THE INVENTION

The present invention provides an improved means and method for coding speech and is particularly useful for coding speech for transmission at low and moderate bit rates.

In its most general form, the method and apparatus of the present invention: (1) quantizes spectral information of a selected portion of input speech using predetermined multiple alternative quantizations, (2) calculates a perceptually weighted error for each of the multiple alternative quantizations compared to the input speed spectral information, (3) identifies the particular quantization providing the least error for that portion of the input speech and (4) uses both the identification of the least error alternative quantization method and the input speech spectral information provided by that method to code the selected portion of the input speech. The process is repeated for successive selected portions of input speech. Perceptual weighting is desirably used in conjunction with the foregoing to further improve the intelligibility of the reconstructed speech.

The input speech is desirably divided into frames having L speech samples, and the frames combined into superframes having N frames, where $N \geqq 2$, typically $N=4$. The error used to determine the most favorable quantization is desirably summed over the superframe. If adjacent superframes (e.g., one ahead, one behind) are affected by interpolations, then the error is desirably summed over the affected frames as well In a first embodiment, alternative quantizations of the spectral information include quantization of combinations of individual frames within the superframe chosen two at a time, with interpolation for any other not chosen frames. This gives at least $S=SUM(N-m)$ for $m=1$ to N, alternative additional quantized spectral information values to choose from.

In a preferred embodiment, one to two additional quantized spectral information values are also provided, a first by, preferably, vector quantizing each frame individually and a second by, preferably, scalar quantization at one predetermined time within the superframe and interpolating for the other frames of the superframe by comparison to the preceding and following frames. This provides a total of S+2 alternative quantized spectral information values for the superframe.

Quantized spectral parameters for each of the S or S+1 or S+2 alternative spectral quantization methods are compared to the actual spectral parameters using perceptual weighting to determine which alternative spectral quantization method provides the least error summed over the superframe. The identity of the best alternative spectral quantization method and the quantized spectral values derived therefrom are then coded for transmission using a limited number of bits.

Pitch is conveniently quantized once per superframe taking into account the presence or absence of voicing. Voicing determines the most appropriate frame to use as a pitch interpolation target during speech synthesis. Energy and voicing are conveniently quantized for every 2–8 frames, typically once per superframe where N=4.

The number of bits allocated per superframe to each quantized speech parameter is selected to give the best compromise between channel capacity and speech clarity. A synchronization bit is also typically included. In general, on a superframe basis, a desirable bit allocation is: 5–6% of the available superframe bits $B_{sf}$ for identifying the optimal spectral quantization method, 50–60% for the quantized spectral information, 5–8% for voicing, 15–25% for energy, 9–10% for pitch, 1–2% for sync and 0–2% for error correction.

For example, in the case of a 600 bps vocoder with a standard 22.5 millisecond frame duration only 13.5 bits can be sent per frame or 54 bits per superframe where N=4. The 54 bits per superframe are desirably allocated as follows: three bits to identify which of the S+2=8 alternative quantization methods gives the least error, 28 to 32 bits for the quantized spectral information, 3–4 bits to identify different voicing combinations, 9–12 bits for energy, 5 bits for pitch, 1 bit for synchronization and 0–1 bits for error correction. This combination provides highly intelligible speech at a 600 bps rate.

DETAILED DESCRIPTION OF THE DRAWINGS

Figure 1:
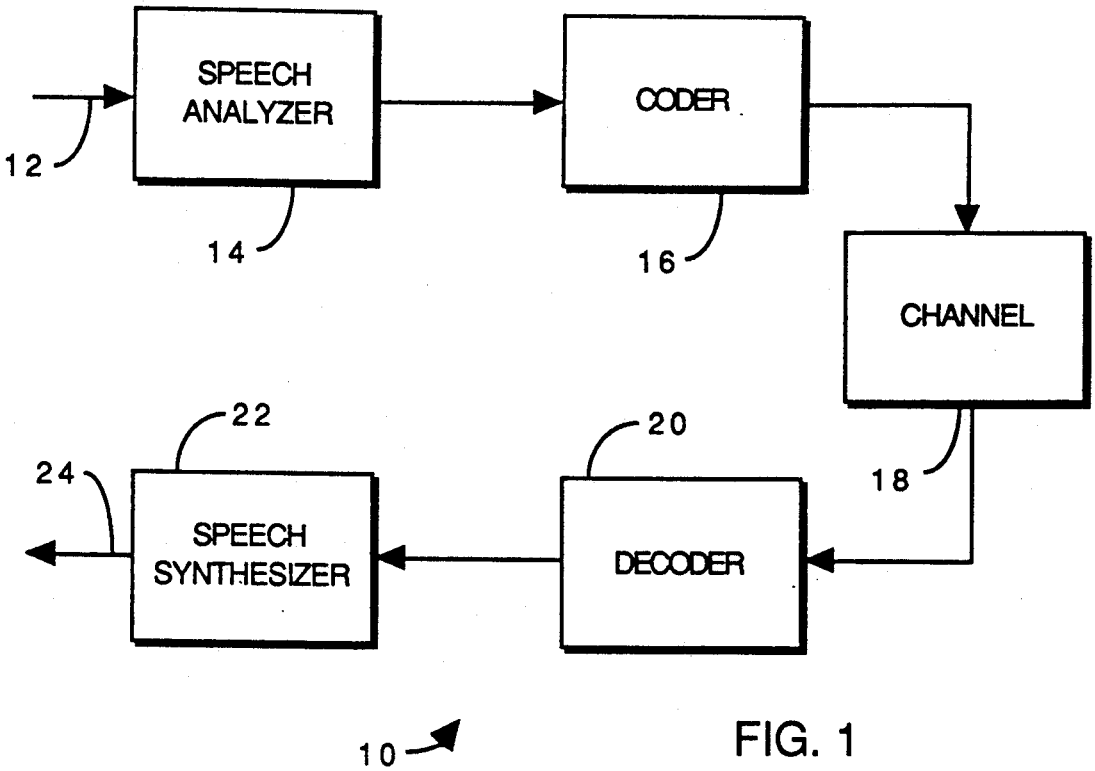
FIG. 1 shows a simplified block diagram of a vocoder communication system.

As used herein the words "scalar quantization" (SQ) in connection with a variable is intended to refer to the quantization of a single valued variable by a single quantizing parameter. For example, if $E_i$ is the actual RMS energy E for the $i^{th}$ frame of speech, then $E_i$ may be "scaler quantized" by, for example, a six bit code into one of $2^6=64$ different quantized levels $E_j$, where $E_j$ is the quantized energy level closest to the actual energy level $E_i$. The greater the number of bits, the greater the resolution of the quantization. The quantization need not be linear, i.e., the different $E_j$ need not be uniformly spaced. For example, by expressing E in db, equal quantization intervals correspond to equal energy ratios rather than equal energy magnitudes. Means and methods for performing scalar quantization are well known in the vocoder art.

As used herein, the words "vector quantization" (VQ) is intended to refer to the simultaneous quantization of correlated variables by a single quantized value. For example, if energy values of successive frames are treated as independent variables, it is found that they are highly correlated, that is, it is much more likely that the energy values of successive frames are similar than different. Once the correlation statistics are known, e.g., by examining their actual occurrence over a large speech sample, a single quantized value can be assigned to each correlated combination of the variables. Determining the likelihood of occurrence of particular values of speech variables by examining a large speech sample is procedure well known in the art. The more bits that are available, the greater the number of combinations that can be described by the quantized vector, i.e., the greater the resolution.

Vector quantization provides more efficient coding since multiple variable values are represented by a single quantized vector value. The number of "dimensions" of the vector quantization (VQ) refers to the number of variables or parameters being represented by the vector. For example, 2 dVQ refers to vector quantization of two variables and 4 dvQ refers to vector quantization of four variables. Means and methods for performing vector quantization are well known in the vocoder art.

As used herein the word "frame", whether singular or plural is intended to refer to a particular sample of digitized speech of a duration wherein spectral information changes little. Spectral information of speech is set by the acoustic properties of the vocal tract which changes as the lips, tongue, teeth, etc., are moved. Thus, spectral information changes substantially only at the rate at which these body parts are moved in normal speech. It is well known that spectral information changes little for time durations of about 10–30 milliseconds or less. Thus, frame durations are generally selected to be in this range and more typically in the range of about 20–25 milliseconds. The frame duration used for the experiments performed in connection with this invention was 22.5 milliseconds, but the present invention works for longer and shorter frames as well. It is not helpful to use frames shorter than about 10–15 millisecond. The shorter the frame the more frames must be analyzed and frame data transmitted per unit time. But this does not significantly improve intelligibility because there is little change from frame to frame. At the other extreme, for frames longer than about 30–40 milliseconds, synthesized speech quality usually degrades because, if the frame is long enough, significant changes may be occurring within a frame. Thus, 20–25 milliseconds frame duration is a practical compromise and widely used.

As used herein, the word "superframe", whether singular or plural, refers to a sequence of N frames where $N \geqq 2$, which are manipulated or considered in part as a unit in obtaining the parameters needed to characterize the input speech. For small N, good synthesized speech quality may be obtained but at the expense of higher bit rates. As N becomes large, lower bit rates may be obtained but, for a given bit rate, speech quality eventually degrades because significant changes occur during the superframe. The present invention provides improved speech quality at low bit rates by a judicious choice of the manner in which different speech parameters are coded and the resolution (number of bits) assigned to each in relation to the size of the superframe. The perceptual weighting assigned to various parameters prior to coding is also important.

For convenience of explanation and not intended to be limiting, the present invention is described for the case of 600 bps channel capacity and a 22.5 millisecond frame duration. Thus, the total number of bits available per frame (600 bits/sec$\times$22.5$\times$10$^{-3}$ sec/frame=13.5 bits/frame) arises from this illustrative assumption. The number of available bits is taken into account in allocating bits to describe the various speech parameters. Persons of skill in the art will understand based on the description herein, how the illustrative means and method is modified to accommodate other bit rates. Examples are provided.

Figure 2:
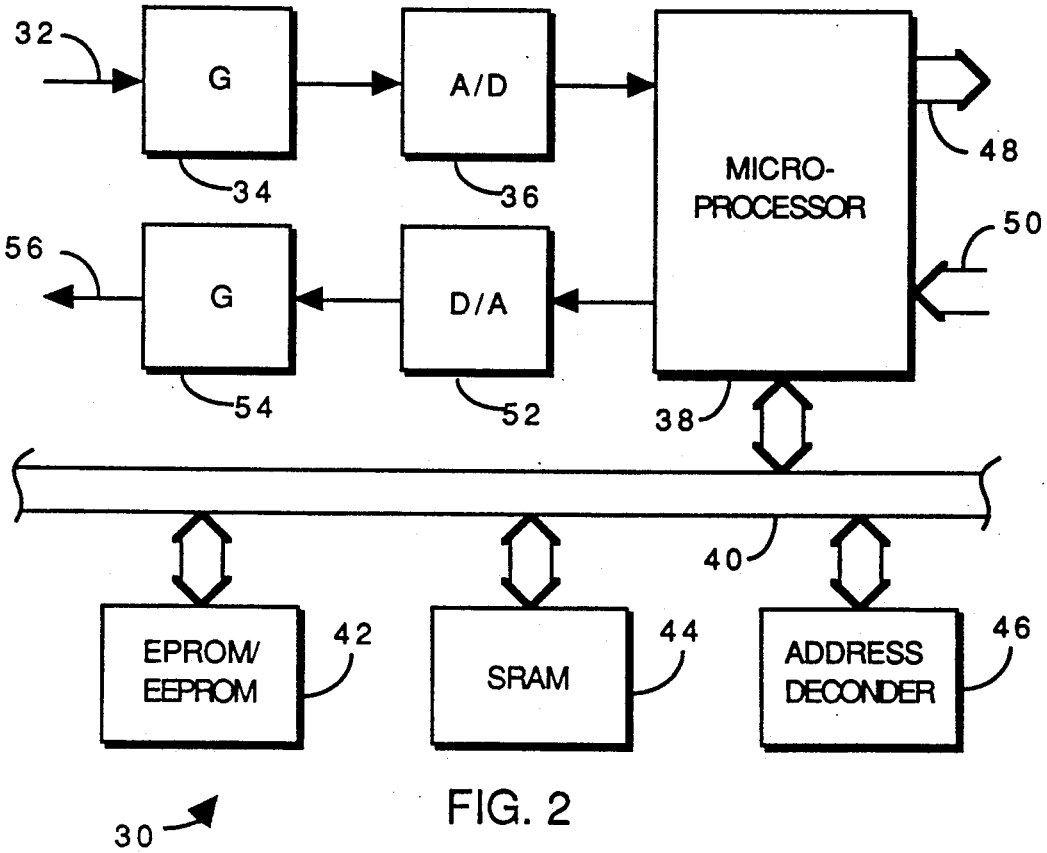
FIG. 2 shows a simplified block diagram of a speech analyzer-synthesizer-coder for use in the communication system of FIG. 1.

FIG. 2 shows a simplified block diagram of vocoder 30. Vocoder 30 functions both as an analyzer to determine the essential speech parameters and as a synthesizer to reconstruct a replica of the input speech based on such speech parameters.

When acting as an analyzer (i.e., a coder), vocoder 30 receives speech at input 32 which then passes through gain adjustment block 34 (e.g., an AGC) and analog to digital (A/D) converter 36. A/D 36 supplies digitized input speech to microprocessor or controller 38. Microprocessor 38 communicates over bus 40 with ROM 42 (e.g., an EPROM or EEPROM), alterable memory (e.g., SRAM) 44 and address decoder 46. These elements act in concert to execute the instructions stored in ROM 42 to divide the incoming digitized speech into frames and analyze the frames to determine the significant speech parameters associated with each frame of speech, as for example, pitch, spectrum, energy and voicing. These parameters are delivered to output 48 from whence they go to a channel coder (see FIG. 1) and eventual transmission to a receiver.

When acting as a synthesizer (i.e., a decoder), vocoder 30 receives speech parameters from the channel decoder via input 50. These speech parameters are used by microprocessor 38 in connection with SRAM 44 and decoder 46 and the program stored in ROM 42, to provide digitized synthesized speech to D/A converter 52 which converts the digitized synthesized speech back to analog form and provides synthesized analog speech via optional gain adjustment block 54 to output 56 for delivery to a loud speaker or head phone (not shown).

Vocoders such as are illustrated in FIG. 2 exist. An example is the General Purpose Voice Coding Module (GP-VCM), Part No. 01-P36780D001 manufactured by Motorola, Inc. This Motorola vocoder is capable of implementing several well known vocoder protocols, as for example 2400 bps LPC10 (Fed. Std. 1015), 4800 bps CELP (Proposed Fed. Std 1016), 9600 bps MRELP and 16000 bps CVSD. The 9600 bps MRELP protocol is used in Motorola's STU-III TM —SECTEL 1500 TM secure telephones. By reprogramming ROM 42, the vocoder 30 of FIG. 2 is capable of performing the functions required by the present invention, that is, delivering suitably quantized speech parameter values to output 48, and when receiving such quantized speech parameter values at input 50, converting them back to speech.

The present invention assumes that pitch, spectrum, energy and voicing information are available for the speech frames of interest. The present invention provides an especially efficient and effective means and method for quantizing this information so that high quality speech may be synthesized based thereon.

A significant factor influencing the intelligibility of transmitted speech is the number of bits available per frame. This is determined by the combination of the frame duration and the available channel capacity, that is, bits per frame=(channel capacity)$\times$(frame duration). For example, a 600 bps channel handling 22.5 milliseconds speech frames, gives 13.5 bits/frame available to code all of the speech parameter information, which is so low as to preclude adequate parameter resolution on a per frame basis. Thus, at low bit rates, the use of superframes is advisable.

If frames are grouped into superframes of N successive frames then, the number of bits $B_{sf}$ per super frame is N times the number of available bits per frame $B_f$, e.g., for the above example with N=4, one has $B_{sf}=N\times B_f=4\times 13.5=54$ bits per superframe available to code the speech parameter information. However, this procedure necessarily introduces errors. Thus, superframe quantization is only successful if a way can be found to quantize and code the speech parameter information such that the inherent errors are minimized.

The use of superframes has been described in the prior art. See for example, Kang et al., "High Quality 800-bps Voice Processing Algorithm," NRL Report 9301, 1990. Superframes of two or three 20 millisecond frames were used in an 800 bps vocoder, so that 32–48 bits were available per superframe to code all the voice parameter information. Spectral quantization was fixed, in that it did not adapt to different spectral content in the actual speech. For example, for N=2, the average LSFs over the superframe were quantized and for N=3, the central frame LSFs were quantized using 18 bits with perceptual weighting to emphasize the lower frequency components and the presence of formant frequencies. No account was taken of the relative position of the spectral information on the Rate-Distortion Boundary curve.

It has been found that satisfactory speech quality can be obtained with N$\geqq$2, but N in the range of about 2–6 is convenient with N=4 being a preferred value. The greater the allowable bit rate, the smaller the value of N that can be used for comparable output speech quality. For example, with high bit rate channels (e.g., >4800 bps), use of superframes provides less benefit, whereas at low to moderate bit rates (e.g., $\geqq$4800 bps) use of superframes is of benefit, particularly for bit rates $\geqq$2400 bps. In general, (1) the superframe should provide enough bits to adequately code the speech parameters for good intelligibility and, (2) the superframe should be shorter than long duration phonemes.

For convenience of explanation and not intended to be limiting, the invented means and method is described for N=4, but those of skill in the art will appreciate based on the description herein that smaller and larger values of N can also be used, and that the same value of N need not be used for all the speech parameters (spectrum, pitch, energy and voicing), i.e., that the superframe size may be varied.

The problem to be solved is to find an efficient and effective way to code the speech parameter information within the limited number of bits per frame or superframe such that high quality speech can be transmitted through a channel of limited capacity. The present invention provides a particularly effective and efficient means and method for doing this and is described below separately for each of the major speech parameters, that is, spectrum, pitch, energy and voicing.

Spectrum Coding

It is common in the art to describe spectral information in terms of Reflection Coefficients (RC) of LPC filters that model the vocal tract. However, it is more convenient to use Line Spectral Frequencies (LSF), also called Line Spectral Pairs (LSP), to characterize the spectral properties of speech. Means and methods for extracting RC's and/or LSF's from input speech, or given one representation (e.g., RC) converting to the other (e.g. LSF) or vice versa, are well known in the art (see Kang, et al., NRL Report 8857, Jan. 1985).

For example, the Motorola General Purpose Voice Coding Module (GP-VCM) in its standard form produces RC's for each 22.5 millisecond frame of speech being analyzed. Those of skill in the art understand how to convert this RC representation of the spectral information of the input speech to LSF representation and vice versa. Tenth order LSF's are considered for each frame of speech.

Figure 3:
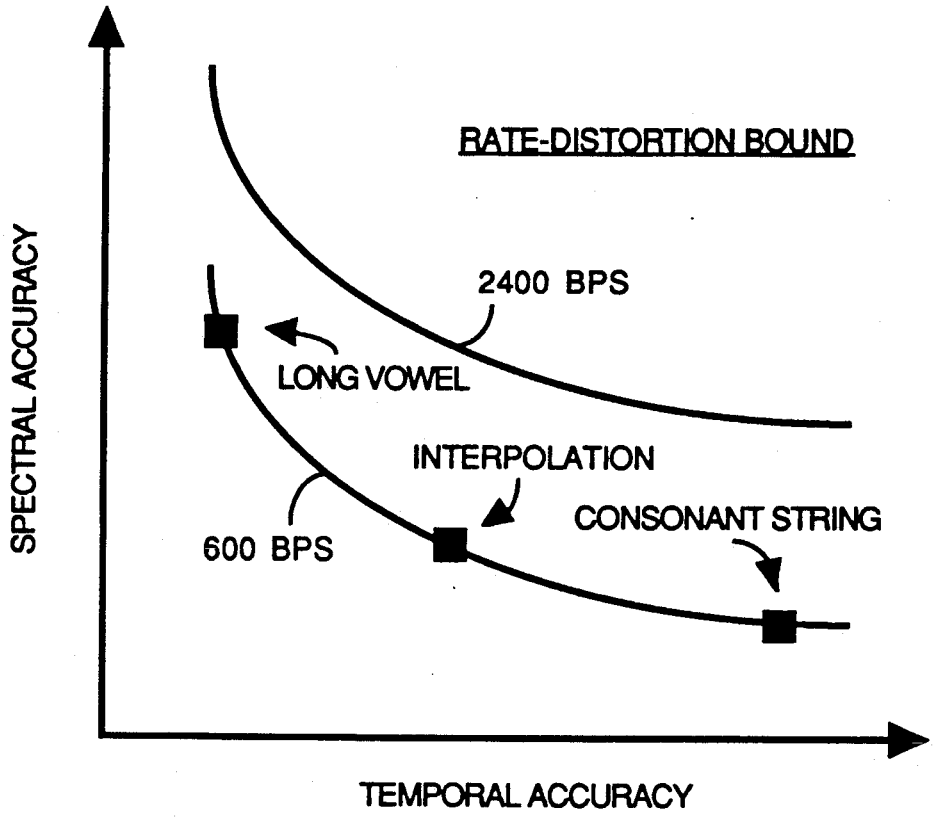
FIG. 3 shows Rate-Distortion Bond curves for vocoders operating at different bit rates.

With respect to the spectral information, it has been determined that it is sometimes perceptually significant to deliver good time resolution with low spectral accuracy, but at other times it is perceptually more important to deliver high spectral resolution with less time resolution. This concept may be expressed by means of Rate-Distortion Bound curves such as are shown in FIG. 3 for a 600 bps channel and a 2400 bps channel. FIG. 3 is a plot of the loci of spectral (frequency) and temporal (time) accuracy combinations required to maintain a substantially constant intelligibility for different types of speech sounds at a constant signalling rate for spectrum information. The 600 bps and 2400 bps signalling rates indicated on FIG. 3 refer to the total channel capacity not just the signalling rate used for sending the spectrum information, which can only use a portion of the total channel capacity.

For example, when the speech sound consists of a long vowel (e.g. "oo" as in "loop"), it is more important for good intelligibility to have accurate knowledge of the resonant frequencies (i.e., high spectral accuracy), and less important to know exactly when the long vowel starts and/or stops (i.e., temporal accuracy). Conversely, when speech consists of a consonant string (e.g., "str" as in "strike"), it is more important for good intelligibility to convey as nearly as possible the rapid spectral changes (high temporal accuracy) than to convey their exact resonant frequencies (spectral accuracy). For other sounds between these extremes, an efficient compromise of temporal and spectral accuracy is desirable.

It has been found that a particularly effective means of coding spectral information is obtained by using a predetermined set of alternative spectral quantization methods and then sending as a part of the vocoded information, the identification of which alternate quantization method produces synthesized speech with the least error compared to the input speech and sending the quantized spectral values obtained by using the optimal quantization method. The strategies used to select these predetermined quantization methods are explained below. $B_{si}$ is the number of bits assigned per superframe for conveying the quantized spectral information and $B_{sc}$ is the number of bits per superframe for identifying which of the alternative spectral quantization methods has been employed.

Of the available $B_{sf}=54$ bits per superframe for the exemplary 600 bps, 22.5 millisecond frame, N=4 implementation, $B_{si}=28$–32 bits are assigned to represent the quantized spectrum information per superframe and $B_{sc}=3$ bits are assigned to represent the alternative quantization methods per superframe. Three identification or categorization bits conveniently allows up to eight different alternative quantization methods to be identified. The categorization bits $B_{sc}$ code the position on the Rate-Distortion Bound curve of the various alternative spectral quantization schemes.

It was found that for rapid consonantal transitions, coarsely quantizing each frame to capture the transitions was the best strategy. This is accomplished preferably by perceptually weighted vector quantizing the LSF's for each frame of the superframe. Since 7–8 bits per frame ($B_{si}=28$–32) are being used to code 10th order LSF values, spectral resolution is low while temporal resolution (once each frame) is relatively high. This type of quantization is well suited to accurately portraying consonant strings where the perceptually most important information is the onset and/or spectral transition of the sound. This corresponds to operating on the rightward portion of the Rate-Distortion Bound curve of FIG. 3.

During steady state speech (e.g., long vowels), finely quantizing one point during the superframe with the maximum number of bits available for representing the spectral parameters, was found to give the best results. For convenience, the mid point of the superframe is chosen, although any other point within the superframe would also serve. For N=4 and $B_{sf}=54$ bits per superframe, a $B_{si}=28$–32 bit delta-frequency scalar quantizer with frequency look-ahead is conveniently used for the spectral information . All four frames of the superframe are interpolated when this quantization method is used. This gives high (e.g., $B_{si}=28$–32 bit) spectral resolution but poor (once per superframe) temporal resolution. Nonetheless, this quantization method is well suited to accurately portray speech consisting substantially of continuous long vowel sounds during the superframe. This corresponds to operating on the leftward portion of the Rate-Distortion Bound curve of FIG. 3.

The choice of the quantization method for operating in the central portion of the Rate-Distortion Bound is more difficult since very many different quantization methods are potential candidates. It was found that the best results were obtained by taking the N frames of the superframe two at a time and vector quantizing each of the chosen two frames with half the number of bits used to quantize the long vowel case described above, and interpolating for the N-2 remaining frames. For N=4 and $B_{sf}=54$ bits per superframe, the $B_{si}=28$–32 bits are divided between the two frames being quantized to give $B_{si}/2=14$–16 bits for each of the two frames. Taking the frames two at a time gives S =SUM(N-m) for m=1 to N, possible combinations. Thus, for N=4, there are six possible alternative combinations of four frames taken two at a time, and each of the chosen two frames is quantized with half the available spectrum bits. This gives approximately equal consideration of the spectral and temporal information during during the N=4 superframe. These two-at-a-time frames are conveniently quantized using a $B_{si}/4$ (e.g., 7–8) bit perceptually weighted VQ plus a $B_{si}/4$ (e.g., 7–8) bit perceptually weighted residual error VQ. Means and methods for performing such quantizations are well known in the art (see for example, Makhoul et al., Proceedings of the IEEE, vol. 73, Nov. 1985, pages 1551–1558).

The S different two-at-a-time alternate quantizations give good information relative to speech in the central portion of the Rate-Distortion boundary, and is the minimum alternate quantization that should be used. The S+1 alternate quantizations obtained by adding either the once-per-frame quantization or the once-per-superframe quantization is better, and the best results are obtained with the S+2 alternate quantizations including both the once-per-frame quantization and the once-per-superframe quantization. This arrangement is preferred. As is explained later, perceptual weighting is used to reduce the errors and loss of intelligibility that are otherwise inherent in any limited bit spectral quantizations.

It will be noted that each of the alternative spectral quantization methods makes maximum use of the $B_{si}$ bits available for quantizing the spectral information. No bits are wasted. This is also true of the $B_{sc}$ bits used to identify the category or identity of the quantization method. A four frame superframe has the advantage that eight possible quantization methods provide good coverage of the Rate-Distortion Bound and are conveniently identified by three bits without waste.

Having determined the alternative spectral quantizations corresponding to the actual spectral information determined by the analyzer, these alternative spectral quantizations are compared to the input spectral information and the error determined using perceptual weighting. Means and methods for calculating the distance between quantized and actual input spectral information are well known in the art. The perceptual weighting factors applied are described below.

The spectral quantization method having the smallest error is then identified. The category bit code identifying the minimum error quantization method and the corresponding quantized spectral information bits are then both sent to the channel coder to be combined with the pitch, voicing and energy information for transmission to the receiver vocoder.

LSF Perceptual Weighting

Perceptual weighting is useful for enhancing the performance of the spectral quantization. Spectral Sensitivity to quantizer error is calculated for each of the 10 LSFs and gives weight to LSFs that are close together, signalling the presence of a formant frequency. For each LSF(n) where n=1 to 10, DeltaFreqDwn(n), LSF(n)−LSF(n−1), and DeltaFreqUp(n), LSF(n+1)-LSF(n), are calculated. When DeltaFreqDwn or DeltaFreqUp is small, the Spectral Sensitivity value is relatively large, signalling that this LSF is especially important to quantize accurately.

Spectral Sensitivity is calculated for the 10 unquantized LSFs (SpecSensUnQ(n)) and for the 10 quantized LSFs (SpecSensQ(n)). These values, along with Weights(n), for n=1 to 10, are used to compute a single TotalSpectralErr figure for the frame. TotalSpectralErr sums (for n=1 to 10) the square of the weighted LSF quantizing distance multiplied by the sum of the quantized and unquantized Spectral Sensitivity for each LSF. The Weight for each LSF is proportional to the spectral error produced by making small changes in the LSF and effectively ranks the relative importance of accurate quantization for each of the 10 LSFs.

The TotalSpectralErr described above characterizes the quantizer error for a single frame. A similar Spectral Change parameter, using the same equations as TotalSpectralErr, can be calculated between the unquantized LSFs of the current frame and a previous frame and another between the current frame and a future frame. When these 2 Spectral Change values are summed, this gives SpecChangeUnQ(m). Similiarly, if Spectral Change is calculated between the quantized LSFs of the current frame and a previous frame and then summed with the TotalSpectralErr(m) between the current frame's quantized spectrum and a future frame's quantized spectrum, this gives SpecChangeQ(m).

A SmoothnessErr(m), for m=1 to N, is calculated for each frame from the the SpecChangeQ and SpecChangeUnQ for that frame. The Smoothness Err for each frame is calculated as:

$$\text{SmoothnessErr}(m) = \text{SpectralChange}Q(m)/\text{SpectralChange}UnQ(m) - 1.0$$

Thus, if the quantized spectrum has changes similar to the unquantized spectrum, there is a small smoothness error. If the quantized spectrum has significantly greater spectral change than the unquantized spectral change then the smoothness error is higher.

Finally, a TotalPerceptualErr figure is calculated for the entire Superframe by summing the SmoothnessErr with the TotalSpectralErr for each of the N frames.

In careful listener tests the alternative quantizers were tested individually and then all together (system picking the best). Each quantizer behaved as expected with the N frame, $B_{si}/4$ VQ best on consonants and the once per superframe $B_{si}$ scalar quantizer best on vowels, and the two-at-a-time $B_{si}/4+B_{si}/4$ VQ better for intermediate sounds. When all S+2 quantizers are enabled so that the system can select the optimal quantizer for the speech content of the frame being analyzed, the synthesized speech quality exceeds that of any of individual speech quantizers acting alone.

Voiced/Unvoiced Coding

The Motorola GP-VCM which was used to provide the raw speech parameters for the test system provides voiced/unvoiced (V/UV) decision information twice per frame, but this is not essential. It was determined that sending voiced/unvoiced information once per frame is sufficient. In some prior art systems, V/Uv information has been combined with or buried in the LSF parameter information since they are correlated. But, with the present arrangement for coding the spectral information this is not practical since interpolation is used to obtain LSF information for the unquantized frames, e.g., the N-2 frames in the S two-at-a-time quantization method and for the once per superframe quantization method.

For a four frame superframe, there are 16 possible voicing combinations, i.e., all combinations of binary bits 0000 through 1111. A "0" means the frame is unvoiced and a "1" means the frame is voiced. Four bits are thus sufficient to transmit all the voicing information once per frame. This would take 4×4=16 bits per superframe. However, it was determined by examination of a large voice database that of the 16 possible voicing combinations, about half are comparatively low probability events. This is shown below, with the eight combinations in the left list being the more likely and the eight combinations in the right list being the less likely.

| Voicing bits | No. Hits. | Voicing bits | No. Hits. |
|---|---|---|---|
| 0000 | 46815 | 1001 | 628 |
| 1111 | 38425 | 1101 | 592 |
| 1110 | 4161 | 1011 | 582 |
| 0111 | 4161 | 0110 | 450 |
| 0011 | 4029 | 0100 | 300 |
| 1100 | 4019 | 0010 | 290 |
| 0001 | 3891 | 1010 | 88 |
| 1000 | 3691 | 0101 | 78 |

A three bit, four dimensional vector quantizer (4 dVQ) was used to encode the voicing information based on the statistically observed higher probability events illustrated above in the left hand list. The quantized voicing sequence that matches the largest number of voicing decisions from the actual speech analysis is selected. If there are ties in which multiple vQ elements (quantized voicing sequences) match the actual voicing sequence, then the system favors the one with the best voicing continuity with adjacent left (past) and right (future) superframes.

This three bit VQ method produces speech that is very nearly equal in quality to that obtained with the usual 1 bit per frame coding, but with less bits, e.g., 3 bits for a four frame superframe versus the $N \times 4 = 16$ bits per superframe which would result from the prior art practice of separately coding each frame. This is an important advantage in low bit rate coders. The bits saved here are advantageously applied to other voice information to improve the overall quality of the synthesized speech.

Voicing Perceptual Weighting

Since all cases of voicing are not represented by the voicing VQ, errors can occur in the transmitted representation of the voicing sequence. Perceptual weighting is used to minimize the perceived speech quality degradation by selecting a voicing sequence which minimizes the perception of the voicing error.

Tremain, et al have used RMS energy of frames which are coded with incorrect voicing as a measure of perceptual error. In this system, the perceptual error contribution from frames with voicing errors is:

$$PE(N) = Voicing\ Error(N) * Voicedness(N)$$

and the total Voicing Perceptual Error is the $$VPE = SUM(from\ M=1\ to\ N)\ PE(M)$$

sum of the perceptual errors from each frame, when coded with each voicing VQ Codebook entry. Voicedness is the parameter which represents the probability of that frame being voiced, and is derived as the sum of many votes from acoustic features correlated with voicing. These include a high degree of low frequency energy, periodicity in the 75–400 Hz band, and an LPC residual with a high peak to RMS ratio. These parameters should be weighted and summed so that voicedness ranges from +1 for highly voiced to −1 for highly unvoiced.

Energy Coding

The energy contour of the speech waveform is important to intelligibility, particularly during transitions. RMS energy is usually what is measured. Energy onsets and offsets are often critical to distinguishing one consonant from another but are of less significance in connection with vowels Thus, it is important to use a quantization method that emphasizes accurate coding of energy transitions at the expense of energy accuracy during steady state. It is found that energy information could be advantageously quantized over the superframe using a 9–12 bit, 4 dimensional vector quantizer (4 dVQ) per superframe. The ten bit quantizer is preferred. This amounts to only 2.5 bits per frame. The 4 dVQ was generated using the well known Linde-Buzo-Gray method. The vocoder transforms the N energy values per superframe to decibels (db) before searching the $2^{10} = 1024$ vector quantizer entries for the best match. The search procedure uses a perceptually weighted distance measure to find the best 4 dimensional quantizing vector of the 1024 possibilities.

It was determined that most frequently, the RMS energy was constant in all four frames or that there was an abrupt rise or fall in one of the four frames. Thus, the total number of RMS energy combinations that must be coded is not large. Even so, it is desirable to focus the vector quantizer on the perceptually important rises and falls in the energy.

Perceptual energy weighting is accomplished by weighting the encoding error by the rise and fall of the energy relative to the previous and future frames. The scaling is such that a 13 db rise or fall doubles the localized weighting. Energy dips or pulses for one frame get triple the perceptual weighting, thus emphasizing rapid transition events when they occur. The preferred procedure is as follows:

1. Convert the RMS energy of each of the four frames in the supeframe to db;

2. or each of the cells in the VQ RMS energy library, the RMS energy error is weighted by:

$$Weight(i) = 1 + A_0 * [\Delta RMS_{left} \Delta RMS_{right}],$$

where i=1, 2, 3, ..., N, and $RMS_{error} = RMS(I) - RMSVQ(i)$, $\Delta RMS_{left} = ABS(RMS(i) - RMS(i-1))$, $\Delta RMS_{right} = ABS(RMS(i) - RMS(i+1))$, $RMSPW_{error} = SUM(i=1,N)\ [(Weight(i) * RMS_{error}(i)]**2$, where * indicates multiply, ** indicates exponentiate, ABS indicates absolute value, and SUM indicates a summation over the dummy variable i for i=1 to i=N, RMS is the actual root mean square energy value in db, RMSVQ is the vector quantized RMS value (which differs from RMS by the quantization error), perceptual "Weight" is the perceptually weighting for each frame, and "left" and "right" refer to adjacent past and future frames, respectively. The cells in the VQ RMS energy library are determined as is common in the art by analysis of the energy characteristics of a large number of voice samples. The RMS quantizer cycles through each cell in the RMS vQ library and compares 4 dvQ vector with the four calculated RMS values of the superframe to determine which perceptually weighted cell provides the best RMS energy quantizing vector. Then, the bits representing the selected perceptually weighted RMS energy VQ cell are placed into the speech parameter bit stream for transmission to the receiver.

Pitch Coding

Normally at least six bits are used to encode the pitch frequency of every frame so as to have at least 64 frequencies per frame. This would amount to 24 bits per superframe for N=4, which is impractical for low bit rate channels. Hence, it is desirable to find a way to send substantially the same information in fewer bits.

In a preferred embodiment, pitch information is quantized using only five bits per superframe (i.e., $B_p=5$), an average of only 1.25 bits per frame. This is conveniently accomplished by coding only one pitch value per superframe using a quantizing look-up table.

The pitch bits $B_p$ per superframe cover the same frequency range as in the prior art. Thus, with $B_p=5$ the frequency steps are somewhat coarser in the log frequency or log period scale. Five bits provide 32 levels of pitch values that are logarithmically distributed over the 3 octaves of the standard LPC pitch range. If the entire superframe is unvoiced, no pitch is encoded and the $B_p$ bits are assigned to error correction.

The pitch coding system interpolates the pitch values received from the speech analyzer as a function of the superframes voicing pattern. For convenience, the pitch values may be considered as if they are at the midpoint of the superframe. However it is preferable to choose to represent superframe a location in the superframe location where a voicing transition occurs, if one is present. Thus, the sampling point may be located anywhere in the superframe, but the loci of voicing transitions are preferred.

If all the frames of the superframe are voiced, then the average pitch over the superframe is encoded. If the superframe contains a voicing onset, the average is shifted toward the pitch value at onset (start). If the superframe contains a voicing offset (stop), the average is shifted toward the pitch value at offset. In this way the pitch contour, which varies slowly with time, is more accurately interpolated even though it is being quantized only once per superframe.

Pitch Perceptual Weighting

The pitch is encoded once per superframe with 5 bits. The 32 values are distributed uniformly over the logarithm of the frequency range from 75 Hz to 40 Hz. When all four frames of a superframe are voiced, the pitch is coded as the pitch code nearest to the average pitch of all four frames. If the superframe contains an onset of voicing, then the average is calculated with double the weighting on the pitch frequency of the frame with the onset. Similarly, if the superframe contains a voicing offset, then the last voiced frame receives double weighting on that pitch value. This allows the coder to model the pitch curvature at the beginning and ending of speech spurts more accurately in spite of the slow pitch update rate.

$$\text{Onset}(m) = /\text{Voicing}(m-1) \text{ .and. } \text{Voicing}(m)$$
$$\text{Offset}(m) = \text{Voicing}(m) \text{ .and. } /\text{Voicing}(m+1)$$
$$P\text{Weight}(m) = \text{Voicing}(m)*(1 + \text{Onset}(m) + \text{Offset}(m))$$
$$\text{AvgPitch} = \text{SUM}\ (m = 1,4)(P\text{Weight}(m)*\text{Pitch}(m)) \text{ divided by } \text{Sum}(m = 1,4)(P\text{weight}(m)).$$

Error Management

When speech information is coded at low or moderate rates, each bit represents a significant amount of speech either in duration, amplitude or spectral shape. A single bit error will create much more noticeable artifacts than in speech coded at higher bit rates and with more redundancy.

Further, when vector quantizers are used, as here, a single bit error may create a markedly different parameter value, while with a scalar coder, a bit error usually creates a shift of only one parameter. To minimize drastic artifacts due to one bit error, all VQ libraries are sorted along the diagonal of the largest eigen vector or major axis of variance. With this arrangement, bit errors generally result in rather similar parameter sets.

When all of the frames of the superframe are unvoiced, the pitch bits are available for error correction. Statistically, this is expected to occur about 40–45 percent of the time. In a preferred embodiment, the $B_p$ bits are reallocated as (e.g., three) forward error correction bits are to correct the $B_{sc}$ code, and the remaining (e.g., two) bits defined to be all zeros which are used to validate that the voicing field is correctly interpreted as being all zeros and is without bit errors.

In addition, bit errors in some of the spectral codes can sometimes introduce artifacts that can be detected so that the disturbance caused by the artifact can be mitigated. For example, when the spectrum is coded using one of the $S^-$ (two-frames-at-a-time) quantizers with a (8+8 bit) VQ and residual VQ, bit errors in either VQ can produce LSF frequencies that are nonmonotonic or unrealistic for human speech. The same effect can occur for the scalar (once-per-superframe) quantizer. These unrealistic frequency codes are detected and trapped out and the suspect spectral information replaced by clamping it at the value of the preceding frame or extrapolating or interpolating from adjacent superframes. This substantially reduces the sensitivity to coding errors in the transmitter and decoding or transmission errors in the receiver.

Depending on the channel capacity and the bit allocation to the principal speech parameters, a parity bit may be provided for transmission error correction.

EXAMPLE

FIGS. 4–7 are flow charts illustrating the method of the present invention applied to create a high quality 600 bps vocoder. When placed in the memory of a general purpose computer or a vocoder such as is shown in FIG. 2, the program illustrated in flow chart form in FIGS. 4 and 5 reconfigures the computer system so that it takes in speech, quantizes it in accordance with the description herein and codes it for transmission. At a receiver, the program reconfigures the processor to receives the coded bit stream, extract the quantized speech parameters and synthesize speech based thereon for delivery to a listener.

Figure 4:
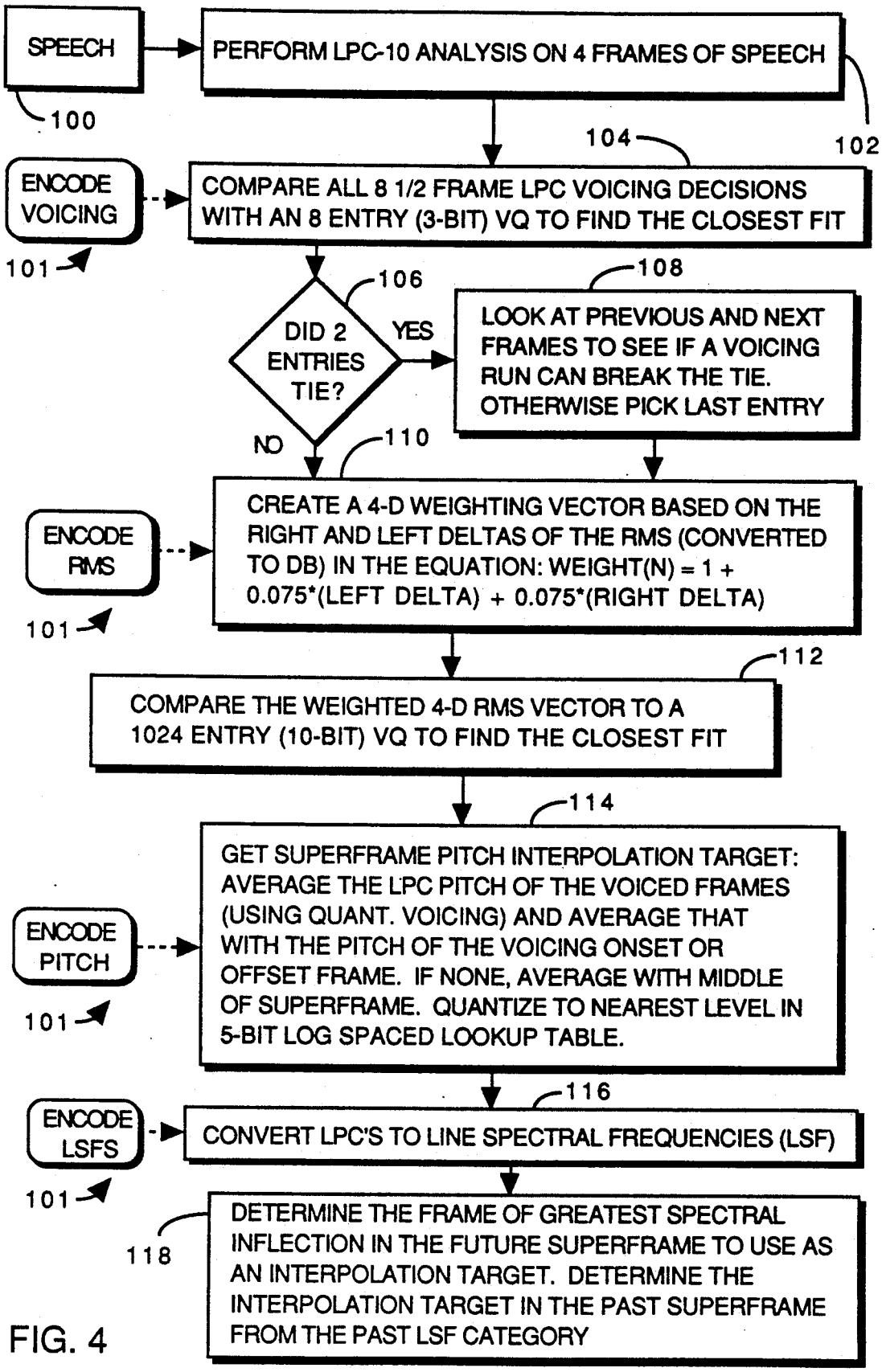
FIGS. 4 through 7 are flow charts for an exemplary 600 bps vocoder according to the present invention.
Figure 5:
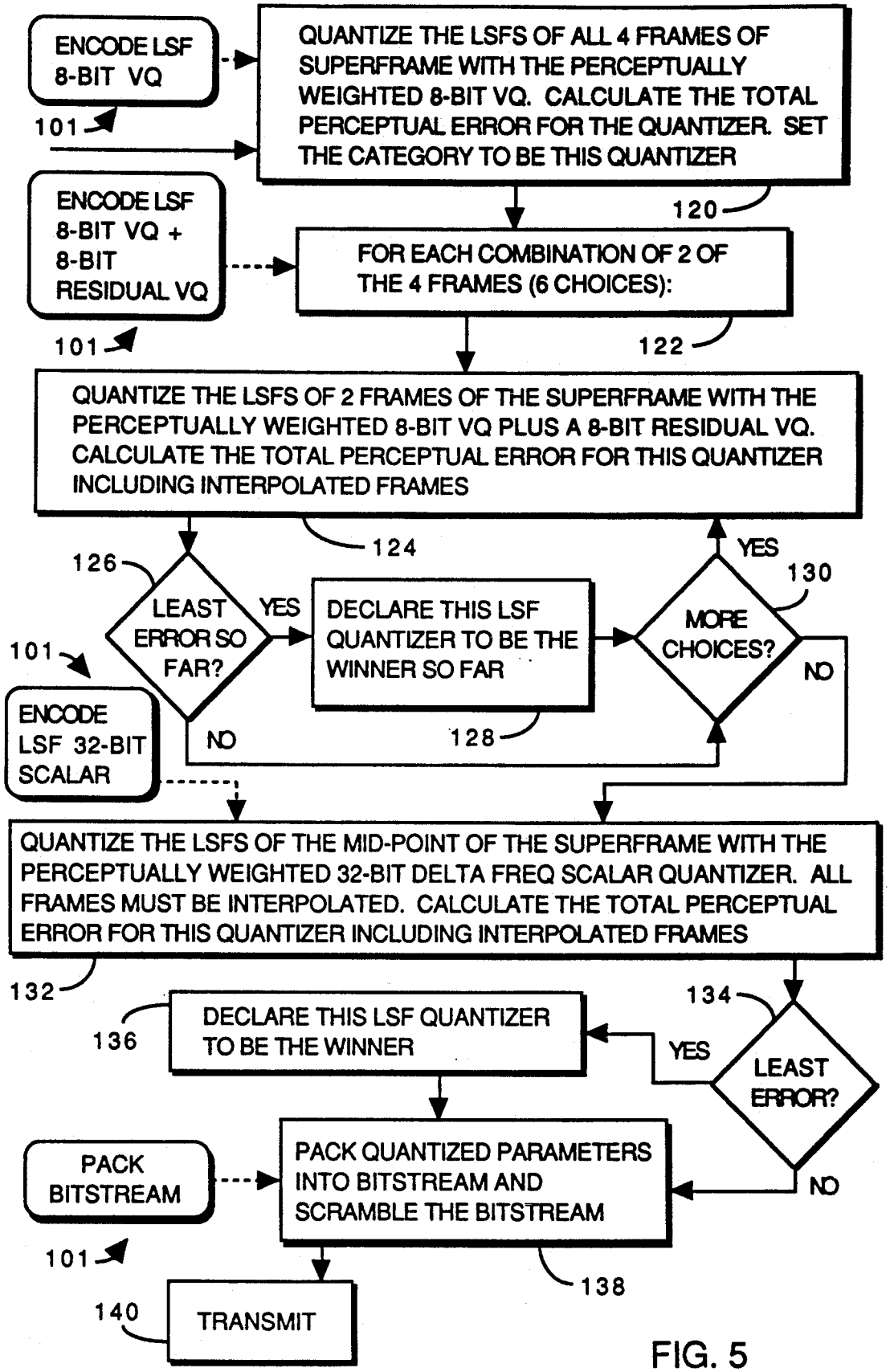

Referring now to FIGS. 4 and 5, speech 100 is delivered to speech analyzer 102, as for example the Motorola GP-VCM which extracts the spectrum, pitch, voicing and energy of however many frames of speech are desired, in this example, four frames of speech. Rounded blocks 101 lying underneath block 100 with dashed arrows are intended to indicate the functions performed in the blocks to which they point and are not functional in themselves.

The speech analysis information provided by block 102 is passed to block 104 wherein the voicing decisions are made. If the result is that the two entries tied (see block 106), then an instruction is passed to activate block 108 which then communicates to block 110, otherwise the information flows directly to block 110. At this point voicing quantization is complete.

in blocks 110 and 112, the RMS energy quantization is provided as indicated therein, and in block 114, pitch is quantized. In blocks 114–136, the RC's provided by the Motorola GP-VCM are converted to LSF's and the alternative spectral quantizations carried out and the best fit is selected. It will be noted that there is a look-ahead and look-back feature provided in block 118 for interpolation purposes. Block 120 (FIG. 5) quantizes each frame of the superframe separately as one alternative spectral quantization scheme as has been previously discussed. Blocks 122–130 perform the two-at-a-time quantizations and block 132 performs the once-per-superframe quantization as previously explained. The total perceptually weighted error is determined in connection with block 132 and the comparison is made in blocks 134–136.

Having provided all of the quantized speech parameters, the bits are placed into a bit stream in block 138 and scrambled (if encryption is desired) and sent to the channel transmitter 140. The functions performed in FIGS. 4 and 5 are readily accomplished by the apparatus of FIG. 2.

Figure 6:
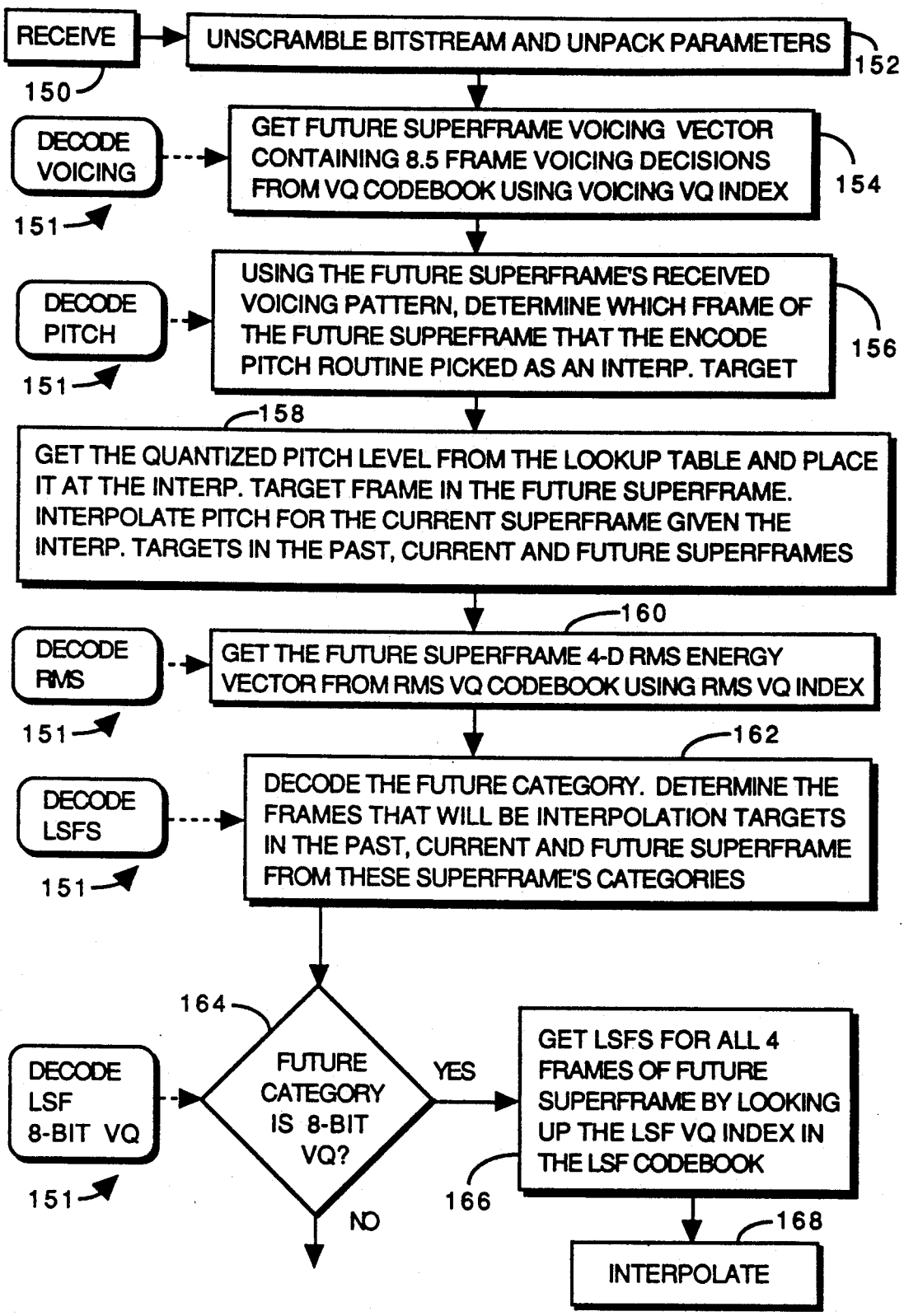
Figure 7:
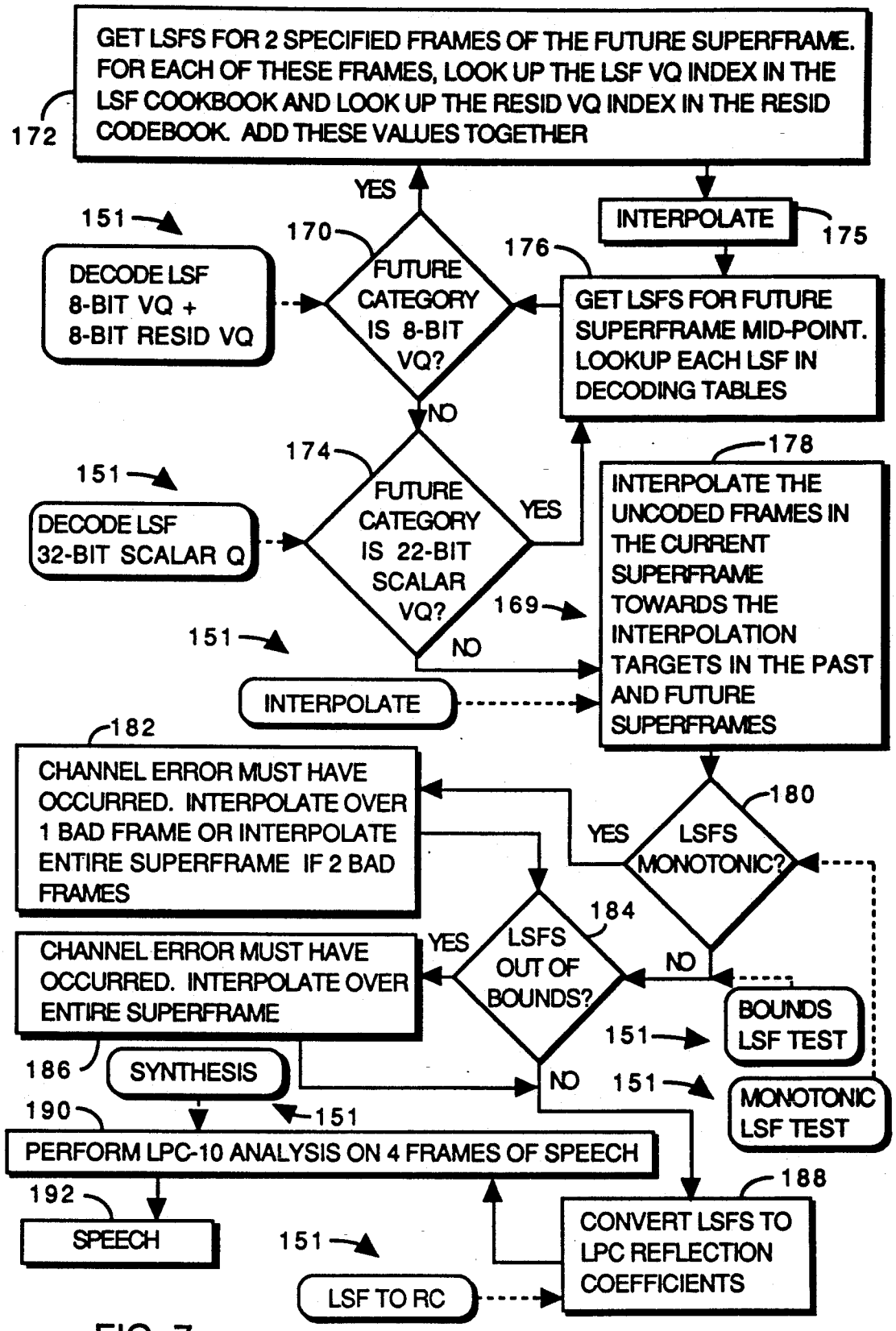

The receiver function is shown in FIGS. 6 and 7. The transmit signal from block 140 of FIG. 5 is received at block 150 of FIG. 6 and passed to decoder 152. Blocks 151 beneath block 150 are merely labels analogous to labels 101 of FIGS. 4 and 5.

Block 152 unscrambles and separates the quantized speech parameters and sends them to block 154 where voicing is decoded. The speech information is passed to blocks 156, 158 where pitch is decoded, and thence to block 160 where energy information is extracted.

Spectral information is recovered in blocks 162–186 as indicated. The blocks (168,175) marked "interpolate" refer to the function identified by arrow 169 pointing to block 178 to show that the interpolation analysis performed in blocks 168 and 175 is analogous to that performed in block 178. In block 188, the LSF are desirably converted to LPC reflection coefficients so that the Motorola GP-VCM of block 190 can use them and the other speech parameters for pitch, energy and voicing to synthesize speech 192 for delivery to the listener.

Those of skill in the art will appreciate that the sequence of events described by FIGS. 4 through 7 are performed on each frame of speech and so the process is repeated over and over again as long as speech is passing through the vocoder. Those of skill in the art will further understand based on the description herein that while the quantization/coding and dequantization/decoding are shown in FIGS. 4 through 7 as occurring in a certain order, e.g., first voicing, then energy, then pitch and then spectrum, that this is merely for convenience and the order may be altered or the quantization/coding may proceed in parallel, except to the extent that voicing information is needed for pitch coding, and the like, as has already been explained. Accordingly, the order shown in the example of FIGS. 4 through 7 is not intended to be limiting.

Evaluation Results

Tests of the speech quality of the exemplary 600 bps vocoder system described above show that speech quality comparable to that provided by prior art 2400 bps LPC10/E vocoders is obtained. This is a significant improvement considering the vastly reduced (one-fourth) channel capacity being employed.

Scaling

The means and method of the present invention apply to systems employing other channel communication rates than those illustrated in the particular example discussed above. In general, on a superframe basis, a desirable bit allocation is: 5–6% of $B_{sf}$ for identifying the optimal spectral quantization method, 50–60% for the quantized spectral information, 5–8% for voicing, 15–25% for energy, 9–10% for pitch, 1–2% for sync and 0–2% for error correction. The numbers refer to the percentage of available bits $B_{sf}$ per superframe.

Based on the foregoing description, it will be apparent to those of skill in the art that the present invention solves the problems and achieves the goals set forth earlier, and has substantial advantages as pointed out herein, namely, that speech parameters are encoded for low bit rate communication in a particularly simple and efficient way, perceptual weighting is applied to speech parameter quantization through simple equations which reduce the computational complexity as compared to prior art perceptual weighting schemes yet which give excellent performance, and that particularly effective ways have been found to encode spectral, energy, voicing and pitch information so as to reduce or avoid errors and poorer intelligibility inherent in prior art approaches.

While the present invention has been described in terms of particular methods and apparatus, these choices are for convenience of explanation and not intended to be limiting and, as those of skill in the art will understand based on the description herein, the present invention applies to other choices of equipment and steps, and it is intended to include in the claims that follow, these and other variations as will occur to those of skill in the art based on the present disclosure.

We claim:

1. A method of analyzing and coding input speech, wherein the input speech is divided into frames characterized at least by spectral information, the method comprising steps of:

forming superframes of $N \geqq 3$ frames;

choosing S combinations of the N frames two at a time, where $S = SUM(N-m)$ for $m=1$ to N to provide S sets of frame pairs;

quantizing spectral information of the S sets of frame pairs to provide S quantized spectral information values;

determining a first set of selected values corresponding to one of the S quantized spectral information values which produces least error when compared to input speech spectral information; and coding the first set of selected values to provide coded signals representing input speech.

2. The method of claim 1 wherein the determining step further comprises determining which of the S quantized spectral information values produces least perceptually weighted error when compared to input speech spectral information to provide the first set of selected values.

3. The method of claim 2 wherein the coding step further comprises coding information identifying which frames within the superframe correspond to the first set of selected values.

4. The method of claim 1 wherein the quantizing step further comprises, for each pair, determining spectral information for each N-2 frames not chosen, by interpolation from quantized spectral information least error values for the chosen frame pair to provide interpolated data included in the coded signals representing input speech.

5. The method of claim 4, further comprising steps of:

incorporating data characterizing energy values and pitch values of the input speech into the coded signals; and incorporating data characterizing energy over the superframe into the coded signals.

6. The method of claim 1 wherein the forming step comprises forming superframes of N≧4 frames.

7. A method of analyzing and coding input speech, wherein the input speech is divided into frames characterized at least by spectral information, the method comprising steps of:

forming superframes of N≧3 frames;

choosing S combinations of the N frames two at a time, where $$S = \sum_{m=1}^{N} (N - m)$$

to provide S sets of frame pairs;

quantizing spectral information of the S sets of frame pairs to provide S quantized spectral information values;

quantizing spectral information of each of the N frames of the superframe individually to provide an alternative quantized spectral information value;

determining which of the alternative spectral information value and the S quantized spectral information values produces least perceptually weighted error when compared to the input speech spectral information to provide a selected value; and coding the input speech using the selected value to provide coded signals representing input speech.

8. The method of claim 7 wherein the coding step further comprises coding information identifying which frames within the superframe correspond to selected value so determined.

9. A method of analyzing and coding input speech, wherein the input speech is divided into frames characterized at least by spectral information, the method comprising steps of:

forming superframes of N≧3 frames;

choosing S combinations of the N frames two at a time, where $$S = \sum_{m=1}^{N} (N - m)$$

to provide S sets of frame pairs;

quantizing spectral information of the S sets of frame pairs to provide S quantized spectral information values;

quantizing spectral information of each of the N frames of the superframe individually to provide a first alternative quantized spectral information value;

quantizing spectral information for the entire superframe to provide a second alternative quantized spectral information value;

determining which of the first and second alternative quantized spectral information values and the S quantized spectral information values produces least error when compared to the input speech spectral information to provide a selected value; and coding the selected value to provide coded signals representing input speech.

10. The method of claim 9 wherein the coding step further comprises coding information identifying which of the first and second alternative quantized spectral information values and the S quantized spectral information values was determined to provide the coded signals representing input speech.

11. The method of claim 9 wherein the step of quantizing spectral information for the entire superframe comprises:

finding quantized spectral information values for all frames in the superframe by interpolation from preceding and following frames to provide interpolated data; and coding the interpolated data to provide coded signals representing input speech.

12. An apparatus for analyzing and coding input speech, comprising:

means for dividing said input speech into frames;

means for determining spectral information for frames of input speech;

means for forming superframes of N≧2 frames;

means for choosing S combinations of said N frames two at a time, where S=SUM(N−m) for m=1 to N, said choosing means coupled to said forming means;

means for quantizing spectral information of chosen frames to provide S alternative quantized spectral information values, which provide reconstructed speech differing from said input speech by some error amount, said quantizing means coupled to said choosing means and to said means for determining spectral information for frames of input speech;

means or determining which of said S alternative quantized spectral information values has least error compared to unquantized input speech spectral information, said means for determining which of said S alternative quantized spectral information values has least error compared to unquantized input speech spectral information coupled to said quantizing means; and means for coding said input speech using a quantized least error spectral information value so determined, said coding means coupled to said determining means.

13. The apparatus of claim 12, further comprising means for identifying which of said S combinations was determined by said means or determining which of said S alternative quantized spectral information values has least error compared to unquantized input speech spectral information, said identifying means coupled to said means for determining which of said S alternative quantized spectral information values has least error compared to unquantized input speech spectral information and to said quantizing means.

14. The apparatus of claim 12, wherein said quantizing means further quantizes spectral information for each N-2 of frames not chosen by interpolation from quantized least error spectral information values for said chosen frames.

15. The apparatus of claim 12 wherein N≧4.

16. The apparatus of claim 15, further comprising means for characterizing quantized energy information and pitch information for frames of said input speech, wherein energy information is quantized over a superframe, said characterizing means coupled to said choosing means and to said means for determining which of said S alternative quantized spectral information values has least error compared to unquantized input speech spectral information.

17. The apparatus of claim 12, wherein said quantizing means quantizes spectral information of each of said N frames of superframe individually so as to provide in combination with said S alternative quantized spectral information values, an S+1st alternative quantized spectral information value and wherein said means for determining which of said S alternative quantized spectral information values has least error compared to unquantized input speech spectral information determines which of said S and S+1st alternative quantized spectral information values has least error compared to unquantized input speech spectral information.

18. The apparatus of claim 17, wherein said quantizing mans quantizes spectral information over said entire superframe so as to provide in combination with said S+1st alternative quantized spectral information value and said S alternative quantized spectral information values, an S+2nd alternative quantized spectral information value and wherein said means for determining which of said S alternative quantized spectral information values has least error compared to unquantized input speech spectral information determines which of said S, S+1st and S+2nd alternative quantized spectral information values has least error compared to unquantized input speech spectral information.

19. The apparatus of claim 18 wherein said quantizing means further comprises means for finding quantized spectral information values for all frames in said superframe by interpolation from preceding and following frames.

* * * * *

UNITED STATES PATENT AND TRADEMARK OFFICE

CERTIFICATE OF CORRECTION

PATENT NO. : 5,255,339

DATED : October 19, 1993

INVENTOR(S) : Bruce A. Fette et al.

It is certified that error appears in the above-indentified patent and that said Letters Patent is hereby corrected as shown below:

Column 16, claim 4, line 68, "each pair" should be --each frame pair--.

Column 20, claim 18, line 2, "mans" should be --means--.

Signed and Sealed this

Twenty-ninth Day of November, 1994

Bruce Lehman

*Attest:*

BRUCE LEHMAN

*Attesting Officer*

*Commissioner of Patents and Trademarks*